US006386588B1

(12) United States Patent
Young et al.

(10) Patent No.: US 6,386,588 B1
(45) Date of Patent: May 14, 2002

(54) SKI POLE GRIP AND STRAP SYSTEM

(76) Inventors: John Young, 12425 Honolulu Ter., Whittier, CA (US) 90601; Charles French, Jr., P.O. Box 703, Ketchum, ID (US) 83340; Robert Youmans, 10733 SW. Cowan Rd., Vashon, WA (US) 98070

( * ) Notice: Subject to any disclaimer, the term of this patent is extended or adjusted under 35 U.S.C. 154(b) by 0 days.

(21) Appl. No.: 09/497,050

(22) Filed: Feb. 2, 2000

(51) Int. Cl.[7] ..... A63C 11/22
(52) U.S. Cl. ..... 280/821
(58) Field of Search ..... 280/817, 816, 280/821, 822, 823; 24/168, 170, 178, 179, 191

(56) References Cited

U.S. PATENT DOCUMENTS

| | | | | | |
|---|---|---|---|---|---|
| 762,732 | A | | 6/1904 | Luhmann | |
| 1,324,080 | A | | 12/1919 | Stephens | |
| 2,946,600 | A | * | 7/1960 | Cubberley | 280/822 |
| 3,163,436 | A | | 12/1964 | Shride et al. | |
| 3,290,049 | A | * | 12/1966 | McDonald | 280/821 |
| 3,344,486 | A | * | 10/1967 | Eveland | 24/191 |
| 3,436,090 | A | | 4/1969 | Lange | |
| 3,545,784 | A | | 12/1970 | Alsop | |
| 3,565,451 | A | | 2/1971 | Giambazi | |
| 3,608,158 | A | | 9/1971 | Bengtsson | |
| 3,662,433 | A | | 5/1972 | Couottet | |
| 3,825,276 | A | * | 7/1974 | Adelmann | 280/821 |
| 3,852,855 | A | * | 12/1974 | Bengtsson | 24/170 |
| 3,982,747 | A | | 9/1976 | Schweinsberg | |
| 4,061,347 | A | | 12/1977 | Stern | |
| 4,082,303 | A | | 4/1978 | Finnegan | |
| 4,162,081 | A | | 7/1979 | Joseph | |
| 4,288,100 | A | | 9/1981 | Aho | |
| 4,932,104 | A | | 6/1990 | Kowal | |
| 4,942,647 | A | * | 7/1990 | Wallner | 24/170 |
| 5,123,674 | A | | 6/1992 | Bagneres | |
| 5,294,152 | A | | 3/1994 | Jacobs | |
| 5,328,205 | A | * | 7/1994 | Bacharach | 280/822 |
| 5,469,583 | A | * | 11/1995 | Akeley et al. | 24/170 |
| 5,549,329 | A | | 8/1996 | Wuerslin et al. | |
| 5,832,569 | A | | 11/1998 | Berg | |
| 5,902,016 | A | * | 5/1999 | Moran et al. | 24/170 |
| 5,908,206 | A | | 6/1999 | LoPresti | |

FOREIGN PATENT DOCUMENTS

| | | | | |
|---|---|---|---|---|
| AT | 116263 | * | 2/1930 | 280/821 |
| DE | 907717 | | 3/1954 | |
| DE | 4103235 | * | 8/1992 | 280/822 |
| EP | 0439053 | | 7/1991 | |
| FR | 2185424 | * | 1/1974 | 280/821 |
| GB | 919589 | * | 2/1963 | 280/821 |

OTHER PUBLICATIONS

Scott USA 97/98 Wintersport Product Catalog—POLES (1997–1998, No Month Given).
Scott 1999/2000 Wintersport Catalog, cover and pole collection (1999, No Month Given).

* cited by examiner

*Primary Examiner*—Frank Vanaman
(74) *Attorney, Agent, or Firm*—Ronald L. Blake; Jenner & Block, LLC

(57) ABSTRACT

A cam buckle system has a lever arm which is pivotally connected to a base plate. The lever arm rotates a lock arm with cam teeth into abutment with a strap to lock the strap against movement. The strap also extends through a capture slot on the lever arm so that manual movement of the strap will open or lock the cam buckle as well as tension the strap. The cam buckle can be used for any tension member, but has particular utility to interconnect a pair of wrist straps of a ski pole grip. The straps and cam buckle form an adjustable length loop which can be tightened to form a heel support for the ski grip. A single point attachment at a top of the handle includes a vertical slot and spreader plate to vertically orient and open the pair of straps. This creates a wrist strap adjustment system that can be quickly manipulated using a single gloved hand.

5 Claims, 4 Drawing Sheets

30
80
86
90
62
94
84
60
70
72
42
46
64
78
24
44
40
26
50
22
76
74
28
88
92

SKI POLE GRIP AND STRAP SYSTEM

FIELD OF THE INVENTION

This invention relates generally to a cam buckle system for interconnecting a strap or other tension member to alter the length thereof, and has particular utility in connection with a ski pole grip and strap adjustment system.

BACKGROUND OF THE INVENTION

Adjustment buckles which interconnect a strap or other tension member allow the length of the strap to be adjusted and tightened around an object. Most adjustment buckles require or are easiest to adjust with two hands. Cam buckles have a handle which the user grasps in his hand and moves upwardly to open clamping teeth which engage the strap when the buckle is locked. The strap is then slidably moved to a tight position, and the user then moves the handle to a closed position to lock the strap in place. In typical adjustment buckles, it is very difficult to perform these operations with a single hand, or in a manner which maintains a tightened position for the strap until it is locked in position.

Adjustment buckles are used to interconnect the wrist strap of a ski pole grip. Most adjustable buckles are intended to be adjusted using two hands, before the skier inserts his hands into the straps in order to use the ski poles. It is generally desirable that the strap be maintained rather snugly around the skier's gloved hand while grasping the ski pole grip. Unfortunately, it is difficult for a gloved hand to enter and exit a snug strap, particularly because the glove is flexible and squishable, and a sufficiently snug fit will partially embed the strap into the glove and make entry and exit difficult. Known types of adjustable buckles which can be adjusted by a free gloved hand while the other gloved hand is secured by a strap have been clumsy and inadequate to allow easy entry and secure tightening of the strap by the free gloved hand.

Ski pole grips may have a platform at the bottom of the handle to partially support the heel of the skier's gloved hand. This allows the ski pole to be firmly planted in the snow while making a turn or to partially support the skier's weight such as when moving skis in a skating motion across level terrain. It would be desirable to provide a ski pole grip in which the heel support for the gloved hand is provided by a looped strap rather than a lower base member on the elongated handle. Some ski pole grips are known in which a strap extends from the top of the handle to the bottom of the handle in order to clamp the gloved hand against the elongated handle. Such two point attachment systems tend to clamp the hand against the elongated handle in a fall and undesirable twisting motion of the ski pole can be transferred to the hand and wrist. In a fall, it is desirable that the strap system should provide only a single attachment point so that the ski pole is free to rotate without forcing a rotation of the skier's hand and wrist. In addition, the strap system should serve to retain the ski pole to the skier's wrist so that the ski pole is not lost during a fall.

For these reasons, a single point attachment of a strap loop to the ski pole grip is very desirable. Unfortunately, such a single point attachment system does not provide a firm heel support for the skier's gloved hand unless the strap loop is adjusted snugly around the gloved hand. Such a snug adjustment, however, makes the strap loop difficult to enter and exit. As a result, it is common to see a wrist strap which is too loose to adequately support the skier's hand when the ski pole is in use. Alternatively, a feasible system must recognize that the skier will be repeatedly exiting the retention strap at the end of each run, such as when getting ready to enter a chair lift when the ski poles should be removed from the skier's hand and wrist.

A common problem, particularly with beginning skiers, is that the retention loop strap may be improperly utilized. When a retention strap loop has a single point attachment at the top of the handle, it drapes downwardly over the handle portion. Some skiers will attempt to enter the loop from the "top" portion and grasp the handle. To properly support the skier's gloved hand both during use and in a fall, the loop retention strap should be entered from the "bottom" upwardly, after which the gloved hand grasps the grip and a portion of the strap which is pressed against the grip. Because of the manner of attachment of the looped strap and how it hangs from the upper portion of the grip, it is not apparent to many skiers how the retention strap should be properly entered and utilized.

It is desirable that a ski pole grip and strap system be universal, meaning that it is not necessary to produce a separate right hand grip and left hand grip. The problem with most universal grips, however, is that they do not adequately support the anatomy of the right hand and the left hand when holding a pair of ski poles. Also, such universal systems commonly do not provide the necessary heel support for a downward pole plant unless they have symmetrical extensions at the base of the handle. To provide a universal platform support for both the right hand and left hand, however, the width of the bottom of the handle is unduly wide, and the length of the handle must be a compromise to fit many hand sizes. Thus, there is a need for a universal ski pole grip and strap system which will accommodate the different sizes of a human hand and the different anatomy of the right hand and left hand of the skier, and yet provide the performance advantages of ski pole grips which are tailored for the right hand and left hand of a skier.

SUMMARY OF THE INVENTION

In accordance with the present invention, a unique cam buckle system allows easy adjustment of strap length and secure locking and opening of the buckle using motions of a single hand rather than both hands as has been typical before. The adjustable buckle has a lever arm which slidably captures a strap in a manner to allow easy adjustment of the strap length by pulling the strap for tensioning around an object. Importantly, while the strap is held in its tensioned position, the free end of the strap can be manipulated to securely lock the cam buckle without loosening of the tension. An opposite movement of the free end of the strap will open the cam lock.

The adjustable buckle system which allows easy and quick tightening of the strap as well as locking or opening of the buckle has particular utility in connection with a novel ski pole grip and strap system. A ski pole handle has a single point strap attachment system at the top of the handle. The buckle interconnects a pair of strap portions into a loop which can be readily tightened or loosened around a gloved hand. Furthermore, a free end of the strap extending from the buckle can be readily grasped by the opposite gloved hand and manipulated to tighten and lock the retention strap with continuous movements of the opposite hand while the gloved hand is gripping the ski pole handle. As a result, the strap system can be tightened so that the looped strap forms a heel support for the bottom of the skier's gloved hand during pole plants. When desired, the buckle system can be readily opened and lengthened to release the skier's hand, such as to remove the ski poles to use a chair lift. The ski pole grip is universal and fits a wide variety of hand sizes, as well as accommodating the right hand and left hand of the skier while still properly supporting the right and left hands during pole plants. The single point attachment for the pair of strap portions is removable and allows customization if desired by the skier.

Because of the manner of quick and secure adjustment of the strap length, the ski pole grip and strap system is more likely to be properly adjusted for optimum performance. In addition, the single point attachment to the handle orients the pair of straps vertically and also opens the straps to allow easier entry of the gloved hand into retention loop. The system includes removable parts which can be interconnected differently should the skier desire to optimize the system for custom performance including the creation of right hand and left hand versions from the ski grip which can be manufactured as a universal part.

DETAILED DESCRIPTION

Figure 1:
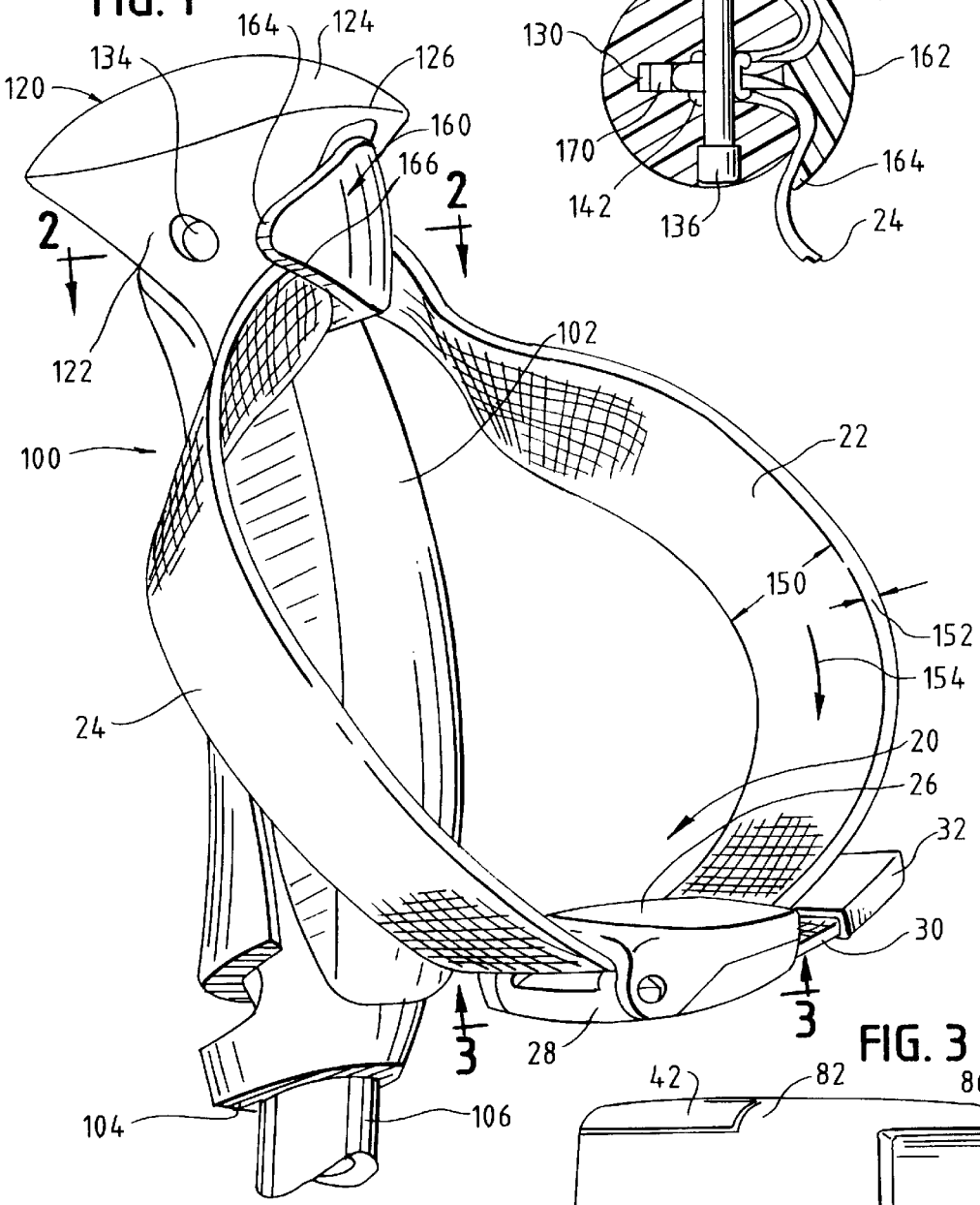
FIG. 1 is a perspective view of a novel cam buckle system used for adjusting a retention loop of a novel ski pole grip and strap system.
Figure 5:
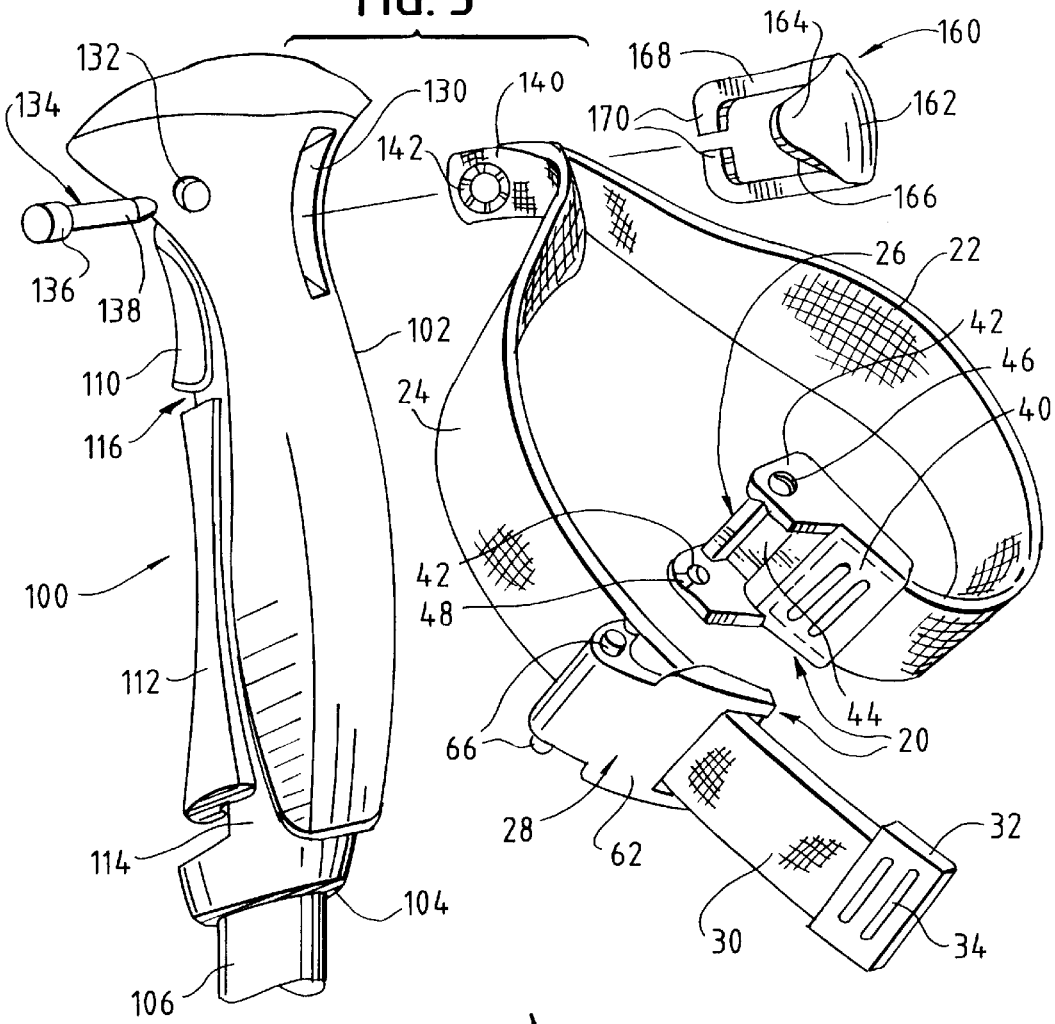
FIG. 5 an exploded view of the systems shown in FIG. 1.

As seen generally in FIGS. 1 and 5, a cam buckle system 20 interconnects a first strap portion 22 to a second strap portion 24 in order to define a loop which can encircle an object 25 such as a skier's gloved hand. The cam buckle system 20 consists of two parts, namely, a base member 26 and a lever member 28 which is movably connected to the base member. The first strap 22 is fixedly secured to the base member 26. The second strap 24 is guided through channels in the cam buckle and exits at a free end 30 which can be grasped by a user in order to adjust the length of the strap loop.

Strap free end 30 may be inserted into a pull grip 32 or end tab having one or more slots 34 which extend into a hollow interior. The grip 32 is fixedly secured to the strap end in any suitable manner. If the grip 32 is formed of metal, it can be crimped or stamped onto the strap end. Preferably, the grip 32 is formed of plastic, and the straps may be woven or formed of a plastic material. The end pull tab 32 may have one or more slots 34 which hold and index the strap in a mold, and the tab 32 is molded in place to the strap. Alternatively, the tab 32 can be heat sealed or glued. The grip tab 32 allows easier grasping of the free end of the strap for pulling and moving the strap. The grip tab 32 prevents the strap end 30 from pulling through the buckle, and also provides a visual reference to the user to indicate what portion is to be gripped by the hand and moved to adjust the strap. However, it is not necessary to include a grip tab 32, and the strap can be terminated in a sewn loop or merely terminated in any suitable manner which prevents unraveling of the strap end and prevents the end from being pulled through the buckle.

Figure 9:
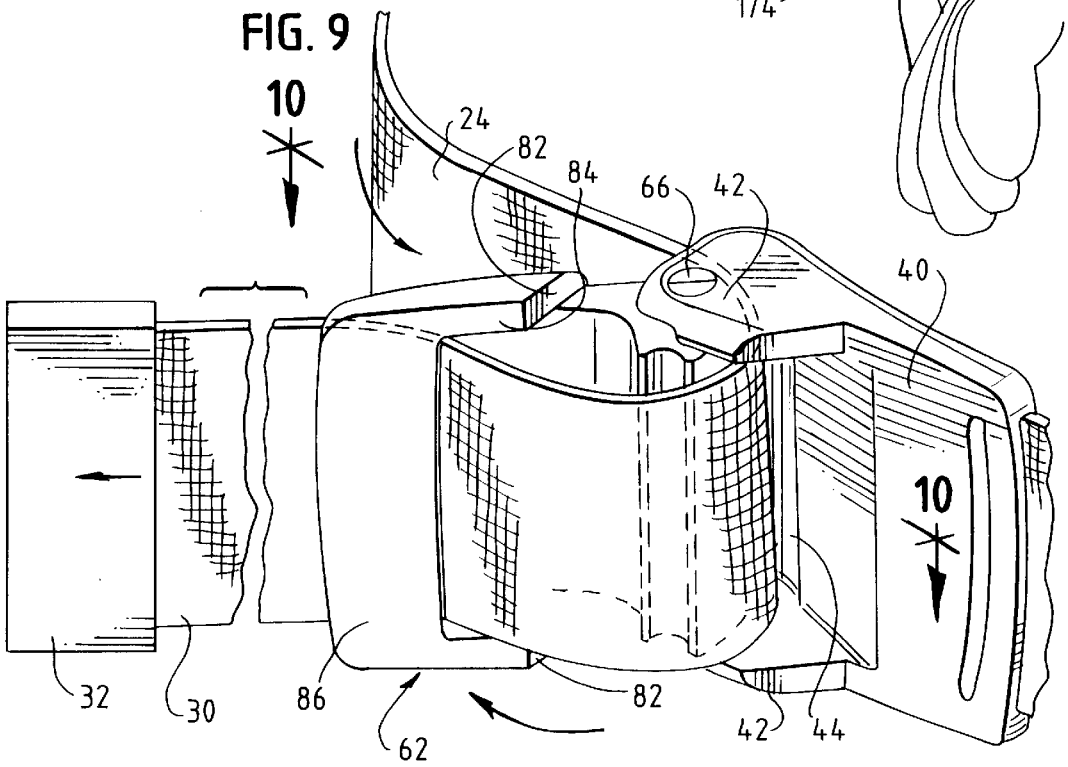
FIG. 9 is an enlarged perspective view of the cam buckle system when in an open position for adjusting the length of the strap.
Figures 10, 11:
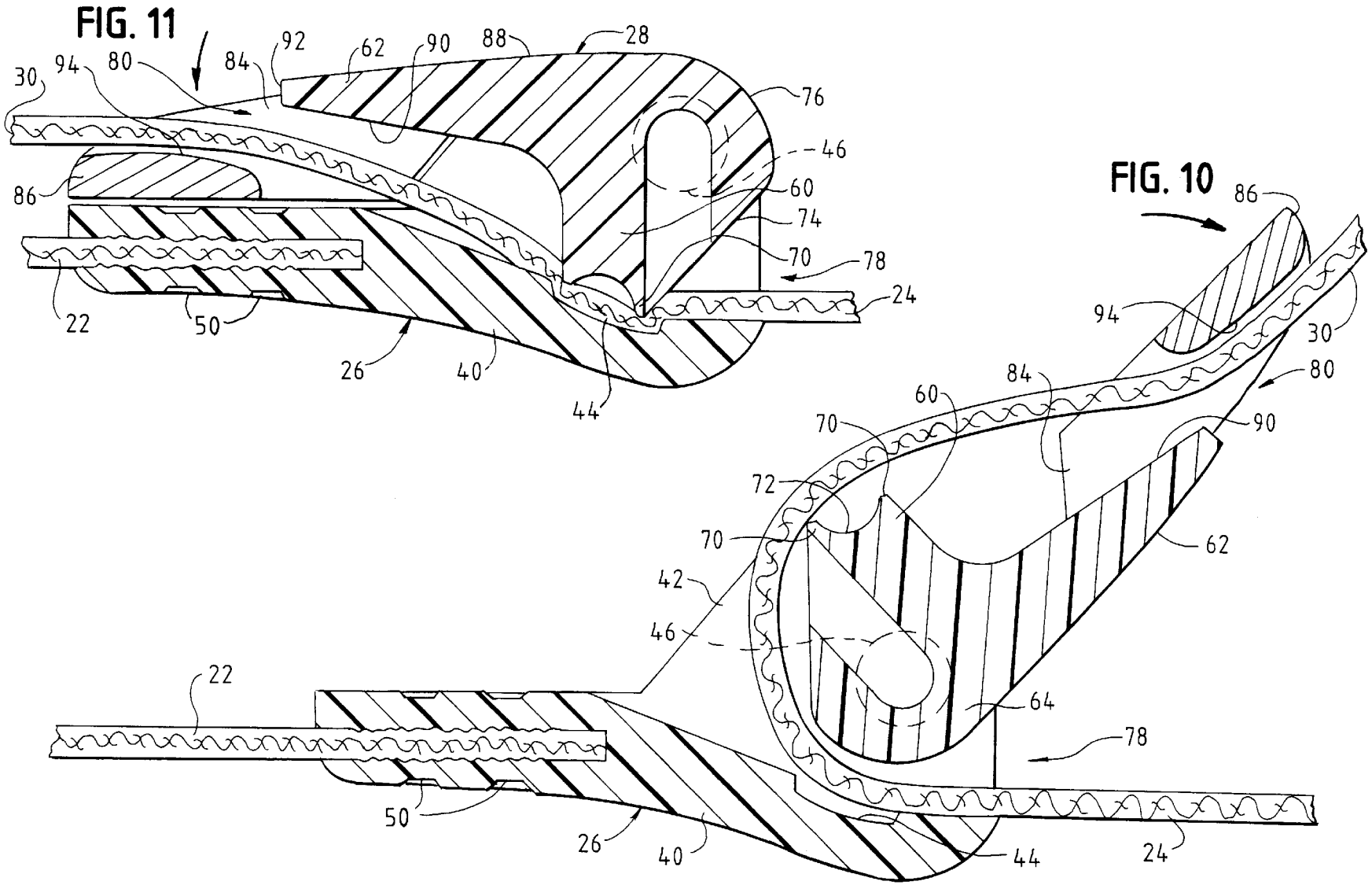
FIG. 10 is a cross-sectional view taken along lines 10—10 of FIG. 9 and showing the cam buckle system in the open position.
FIG. 11 is a cross-sectional view similar to FIG. 10 with the cam buckle system rotated into a locked position for clamping the strap against movement.

Base member 26 consists of a lower plate 40 having a pair of side flanges 42, see FIG. 9, which are spaced apart a distance slightly greater than the width of strap 24. The pair of side flanges form a channel for guiding the strap 24 in a sliding manner through the cam buckle. A locking recess or groove 44 in the base plate 40 extends between the pair of side flanges 42. The side flanges each contain a bearing hole 46 which extend through the flange. The pair of bearing holes 46 are coaxial and serve to define a pivot axis for the upper lever member 28. As seen in FIGS. 10 and 11, each bearing hole 46 is spaced above and in front of the locking groove 44. The center of the pivot axis for the bearing holes 46 when projected vertically downward falls off-center and in front of the rectangular locking groove 44. Above each bearing hole 44, a side recess 48 as seen in FIG. 5 serves to guide a pivot pin into snap-fit connection inside the bearing holes 42 during assembly.

A terminating end of the first strap portion 22 is fixedly secured to the base member 26 in any suitable manner. The base plate can be hollow, as seen in FIGS. 10 and 11, to allow the end of strap 22 to be inserted therein. A plurality of slots 50 extend through the plate and allow the strap to be held and indexed in a mold and molded in place to permanently fix the strap end to the base member. Alternatively, the base plate 40 can be heat sealed or glued or can be solid and have one or more slots extending through the plate. The end of the first strap 22 can then loop through the slot and be folded back onto itself and sewn in order to secure the first strap to the base member.

Lever member 28 consists of a double-armed angular lever having a locking arm 60 and a projecting lever arm 62 which extends generally at a right angle. i.e. 90°, to the locking arm. An intermediate neck portion 64 between the pair of arms contains a pair of pivot pins 66, see FIG. 5, which project coaxially outward from the intermediate bridge body 64. Pin 66 are received in the bearing holes 46 and serve to pivotally connect the two-armed lever member 28 to the base member 26.

Locking arm 60 as seen in FIGS. 9–11 extends from the intermediate neck 64 to a cam surface consisting of a pair of locking teeth 70 with an arcuate concave recess 72 therebetween. When the lever arm 62 is rotated to a closed position as seen in FIG. 11, the cam locking teeth 70 project toward when rotated from a closed position and are spaced a small distance above the locking groove 44 of the base plate 40. The teeth 70 are spaced above the bottom surface forming the groove by an amount slightly less than the thickness of the woven strap 24, and serve to lock the strap 24 by cam action or jam action when the lever arm 62 is closed. More particularly, the teeth 70 serve to compress the strap 24 into the locking channel to firmly jam or lock the strap 24 against motion. The concave recess 72 allows a portion of the strap to be bunched and extend into the recess area as the lever arm 62 is rotated to its fully closed position. The locking teeth 70 are off-center from the pivot access defined by the bearing holes 46 and pivot pins 66. A type of detent action is created upon closure of the lever arm due to the off-center location of the lever arm.

The locking arm 60 has a slanted front face 74, see FIG. 11, which extends into an arcuate face 76 for the intermediate neck body 64. The top of the arcuate face 76 projects rearwardly to form a planar top surface for the lever arm 62. A generally rectangular guide slot 78 is defined by the front faces 74 and 76 of the lever arm 62, the forward edge of the base plate 40, and the pair of side flanges 42 of the base plate. The second strap portion 24 extends through the guide slot 78 and past a somewhat perspective channel defined by the locking recess 44 and locking teeth to be a rear section of the buckle. Then, the second strap portion passes through a capture mechanism 80 on and near an end region of the lever arm 62.

The capture mechanism 80 serves to contain or capture the second strap portion 24 to allow sliding motion for tensioning the strap as well as transferring upward or downward movement of the second strap 24 into rotation of the lever arm 62 in order to open or close the cam buckle. In one preferred embodiment, the capture mechanism 80 consists of an angular capture slot which extends through an end portion of the lever arm 62. More particularly, the intermediate neck 64 of the arm extends rearwardly to a pair of shoulders 82, see FIG. 9, which project sidewardly outward and then rearwardly alongside side rails 84 to a rear bar 86. The lever arm has a generally planar top face surface 88 and a tapered bottom lifting face 90, see FIG. 11, which terminates at an edge 92.

A closing face 94 is formed in an upper surface of the rear bar 86, see FIGS. 10 and 11, against which the second strap 24 presses when moved downwardly. Thus, the angular capture slot 80 is defined by the slanted lifting face 90 and the generally horizontal closing face 94 which each allow sliding movement of the second strap 24 over the faces and preset stop or abutment surfaces to the second strap 24 when moved normal to the angular slot. The sides of the arcuate capture slot are defined by the side rails 84 and serve to retain the strap within the capture slot.

In operation, the closed or locked position of the cam buckle is seen in FIG. 11 in which the second strap 24 is firmly clamped against motion by cam teeth 70. To open or release the cam buckle, the second strap 24 is lifted upwardly with respect to the base member 26 by upward motion on the strap free end 30 or on the grip piece 32. The upward motion causes the wide face of the second strap to engage the lifting face 90 and thereby rotate the pivoted lever arm 62 in a clockwise direction relative to the pivot axis of FIGS. 10–11. The user continues to move the strap upwardly and toward the front of the cam buckle until reaching the fully open or release position shown in FIGS. 7 and 10. The lever arm 62 is now beyond a vertical position with respect to the horizontal base plate 26, and has been rotated through the first quadrant (90°) and well into the second quadrant, such as about 145°.

Figure 7:
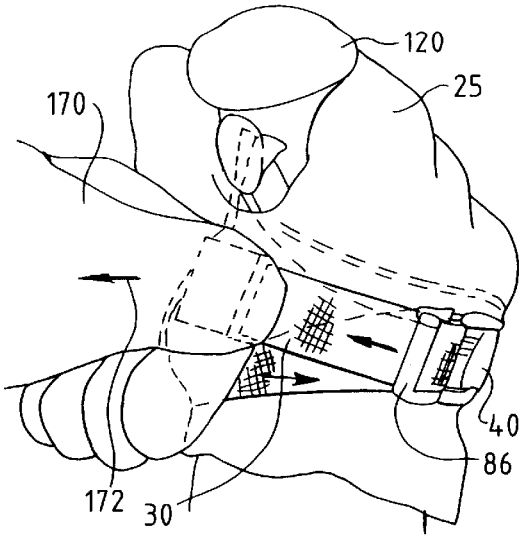
FIG. 7 is a perspective view showing how a skier's free hand can adjust the strap loop to a snugged position.

In this open position, the locking teeth 70 force away from the locking recess 44 and serve instead as a guide which allows free sliding motion of the second strap 24. The strap now can be pulled or tensioned to close the loop tightly as seen in FIG. 7, or relaxed and pushed to open the loop. Once the size of the loop is adjusted as desired, the free end 30 of the second strap 24 is moved counterclockwise with respect to the pivot axis of FIGS. 10 and 11 to press against the closing face 94 of the lever arm. This rotates the lever arm until reaching the closed or locked position seen in FIGS. 8 and 11. Thus, a continuous series of movements of a single hand when grasping the strap free end can tension or relax the strap, and also can lock or open the cam buckle. This operation will be further explained with respect to the novel ski pole grip and strap system which illustrate a particularly advantageous use of the cam buckle system.

The strap portions 22 and 24 can be woven or formed of cloth, plastic or other fabric. The material should have sufficient flexibility so that the cam teeth will jam the strap against movement and sufficient strength to prevent undue deterioration of the strap. The reference to a strap encompasses a band or web or rope or any other tension member having similar characteristics. The cam buckle system 20 can be used to adjust straps for luggage, a backpack, or a wide variety of items which need to be speedily tensioned as well as locked and unlocked by simple hand movement, particularly by use of a single hand. Furthermore, it is not necessary that a strap portion 22 be attached to the buckle. The base member 26 can be directly attached to an object, and a single strap portion 24 can be led through the cam buckle system for adjustment of the strap toward or away from the buckle. The components forming the cam buckle system desirably can be molded of plastic, but other materials can be utilized if desired. One particularly advantageous use of the cam buckle system is in connection with a ski pole system in which the strap can be considered a functional part of the ski grip rather than merely a leash to tether a skier's wrist to a ski pole.

Figure 6:
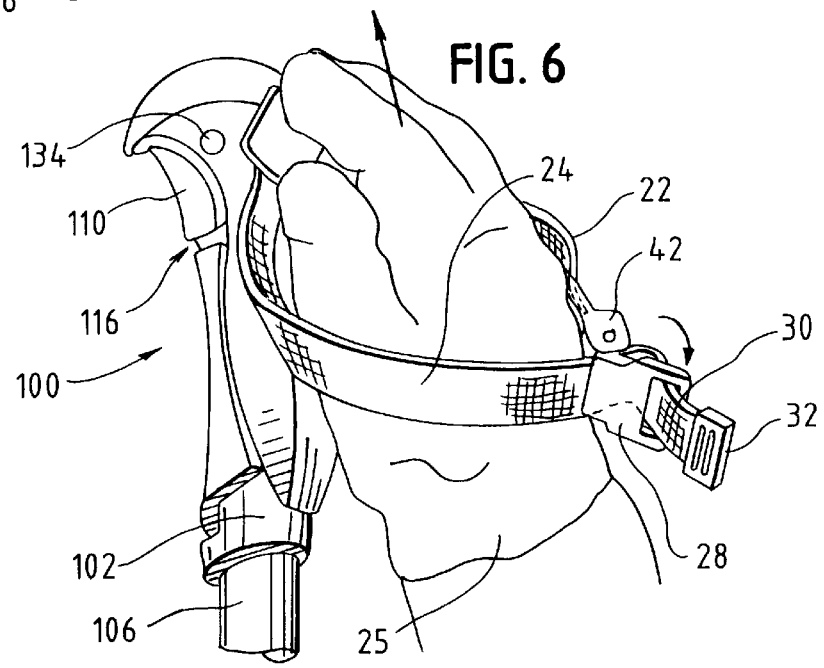
FIG. 6 is a perspective view showing proper entry of a skier's gloved hand into the strap loop of the system shown in FIG. 1.

As seen in FIGS. 1, 5 and 6, a ski pole grip 100 consists of an elongated handle 102 having a hollow cylindrical center open at its lower end 104. A ski pole shaft 106 extends into the hollow interior of the handle 104 and is snugly engaged therein to retain the handle on the ski pole shaft. The length of the handle 102 can be enlarged from standard lengths to accommodate a wide range of hand sizes, because the function of a heel platform is performed by the strap system rather than a bottom ridge on the handle. As seen best in FIGS. 5 and 6, a forward facing side of the handle 102 may contain a index finger grip surface 110 and spaced therebelow a separate front facing grip surface 112 for the remaining three fingers of the skier's gloved hand. The finger retention surfaces 110 and 112 may be arcuate raised surfaces extending outward from a reduced diameter central core 114. Desirably, a gap 16 is located between the index finger surface 110 and the remaining finger surfaces 112 in order to visually indicate to the skier how to orient the hand when grasping the grip 100 for use during skiing.

Ski grip handle 102 terminates in a bulbous top 120 spaced above the hollow interior. The top includes a neck region 122 which flares outwardly to a smooth arcuate cap 124 which is concave with respect to a rim 126. The outwardly flaring neck 122 serves as an upper platform which urges the ski pole grip upwardly as the skier's hand goes through an upward motion. The top portion 120 has a generally mushroom shape in which the encircling rim 126 is of greater diameter than the diameter of the central body portion of the handle 102.

The neck portion 122 has a rear elongated vertical slot 130, see FIG. 5, which is coaxial with the elongated handle 102. As is standard practice, the hollow cylindrical center may be offset several degrees from a center line of the ski pole shaft 106, so that the ski pole shaft 106 extends forwardly several degrees when the handle 102 is held vertically to ground by the skier. Thus, the narrow vertical slot 130 is coplanar with the axes of the ski pole shaft 106 and the handle 102.

Figure 2:
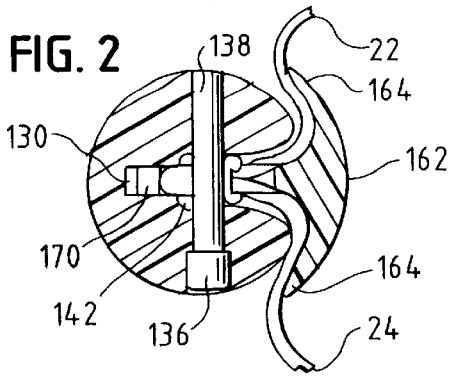
FIG. 2 is a sectional view along lines 2—2 of FIG. 1 and illustrating a single point attachment system for connecting strap portions to the top portion of the ski grip.
Figure 3:
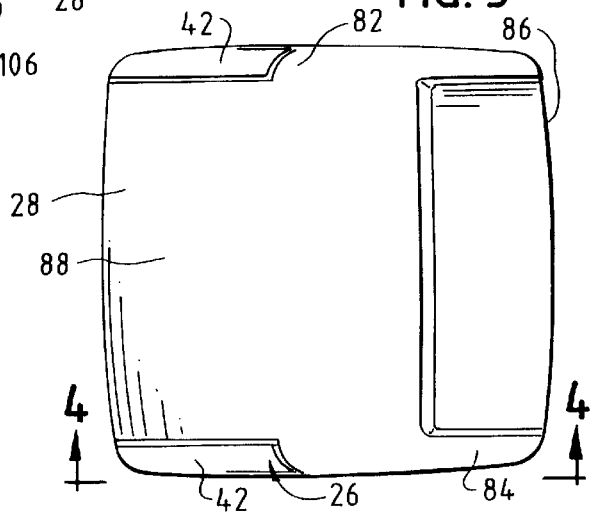
FIG. 3 is a top view of the cam buckle system taken along lines 3—3 of FIG. 1.
Figure 4:
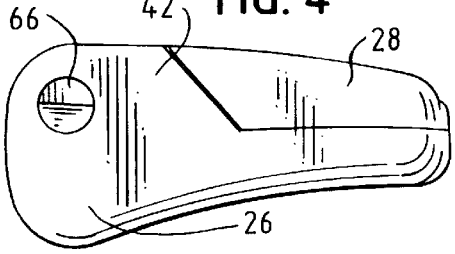
FIG. 4 is a side view of the cam buckle system taken along lines 4—4 of FIG. 3.

The vertical slot 130 extends from the rear into the top portion beyond the center of the handle, as can be seen in FIG. 2. A horizontal cylindrical bore 132, see FIG. 5, extends entirely through the grip top from one side to the other side. The horizontal cylindrical opening or bore 132 intersects the vertical slot 130 to form a single point attachment system for the wrist retention loop consisting of strap portions 22 and 24 which are interconnected by the cam buckle 20. A removable mounting pin 134 is insertable into the horizontal bore 132 to attach the strap loop to the handle 102. The mounting pin 134 has an enlarged head 136 which seats within an enlarged opening of the bore 132, and a shaft 138 which snugly engages the horizontal bore 132. The end of the shaft 138 is tapered slightly to form a self-centering mechanism for capturing the straps, as will be explained.

As seen best in FIG. 5, the first strap portion 22 and the second strap portion 24 can be formed of a continuous length of strap which is folded into a narrow loop 140, i.e., the straps are pinched together, and a circular hole is punched through the abutting straps. A metal grommet 142 is inserted through the hole and flattened on from both sides to form the attachment point for the strap loop. To secure the strap, the loop head 140 is inserted into the vertical slot 130 until the center axis of the grommet 142 aligns with the horizontal bore 132. Then, the mounting pin 134 is pressed through the bore and the mounting grommet 142 and extends into the horizontal bore on the opposite side to securely capture the strap loop within the handle. The end of the shaft 138 is desirably tapered so that it will force the grommet 142 to its center position if it is not precisely aligned with the center axis of the horizontal bore 132. The mounting pin 134 is designed to be removable by the user inserting a narrow object into the bore 132 opposite the head 138, and pushing against the mounting pin to force it out of the handle. This allows the ski strap to be replaced or flipped in orientation in order to customize the ski pole grip for the right and left hands of the skier, as will be explained later.

The vertical orientation of the elongated slot 130 provides advantages over the horizontal orientation of the typical ski pole grip. The vertical orientation of the slot causes the wide straps 22 and 24 to be vertically oriented and flop open. The straps have a width 150, see FIG. 1 which is substantially greater than its thickness 152. A longitudinal extent 154 of the strap can be pulled or loosened to tension or release tension of the strap members around the object 25. Because of the vertical orientation of the slot 130 and the horizontal orientation of the mounting pin 134, the strap width 150 exits the handle in a vertical plane. This orients the straps as seen in FIG. 6 so that the skier's gloved hand 25 can readily enter the straps from the bottom and extend upwardly. In contrast, typical ski pole grips have a horizontal slot in which the pair of straps exit the grip horizontally with one strap laying on top of the other. The straps must be twisted vertically by the skier's hand for proper use. This is confusing to a novice skier and makes the straps more difficult to enter and exit.

The vertically oriented strap portions 22 and 24 are maintained in a spread-open position by a spreader member 160, seen best in FIGS. 1, 2, 5 and 6. Spreader member 160 includes an arcuate spreader head or plate 162 with a pair of ears 164 on each side. Each rounded ear creates a slanted edge 166 which tapers to the center body in order to spread apart the straps. Extending outwardly from a top and bottom of the plate 162 are a pair of flexible legs 168 which terminate in a pair of feet 170 which curve towards each other and have a small gap therebetween. The feet 170 can be spread apart to snap over the strap loop 140 and grommet 142, see FIG. 5, so as to encircle the pinched straps 140 and grommet 142. Then, the spreader 160 is inserted into the vertical slot 130, and the pin 134 is inserted to capture the grommet 142. The height of the vertical slot 130 is slightly greater than the vertical height of the outer surfaces of the feet 168. The upper and lower walls of the vertical slot 130 will engage the feet 168 and prevent further spreading of the feet once located within the vertical slot, thus capturing the spreader member 160 and straps within the handle.

As seen in FIGS. 1 and 6, the slanted edges 166 of the spreader plate 162 serve to open and keep apart the strap portions 22 and 24. This makes it easier for a skier to insert his or her gloved hand 25 into the opened loop as seen in FIG. 6. Because the spreader plate 162 is a symmetrical diamond or four sided shape, with pairs of tapering edges 166 which slant towards the ears 164, the orientation of the spreader plate is immaterial, and the plate can be inserted as illustrated or flipped 180° and will still spread apart the straps. This prevents a skier from making a mistake when remounting the strap loop to the ski pole handle.

Figure 8:
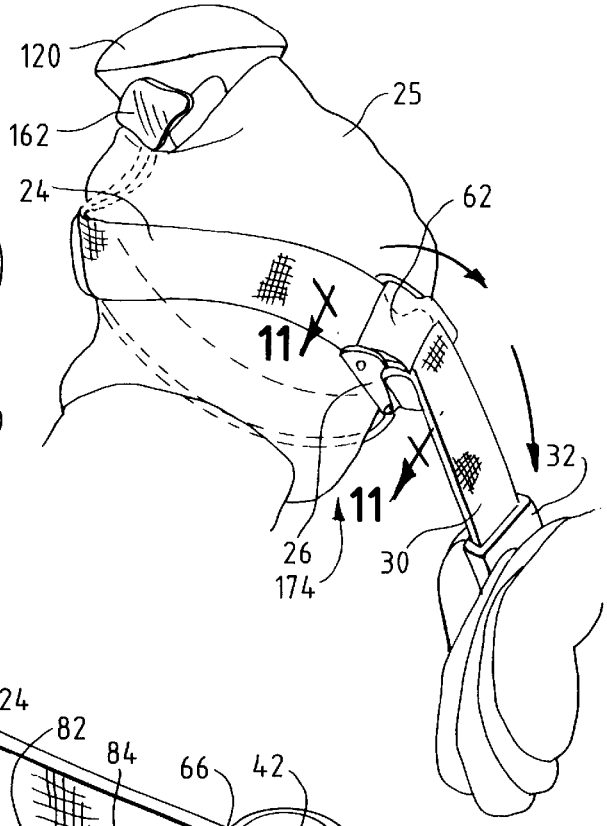
FIG. 8 is a perspective view showing how a skier's free hand can move from the snugged position of FIG. 7 to a locked position with a single hand movement on the free end of the strap.

The novel ski pole grip and strap adjustment system 100 provides a number of performance advantages for a skier. To enter the strap system, the cam buckle may be opened and the strap loop loosened to allow the skier's gloved hand 25 to be inserted as seen in FIG. 6 from the bottom into the strap loop. The skier then grasps the handle 102, which causes the upper portions of the straps 22 and 24 to lie flat against the handle. Then, the other gloved hand 170 grasps the free strap end 30 or grip pole 32 and moves the strap in a direction 172, see FIG. 7, to tension the strap snugly around the gloved hand 25. While maintaining tension on the free end 30, the other gloved hand 172 rotates upward and over the cam buckle, as seen in FIG. 8, and moves downwardly to lock the cam buckle. Because the user can keep continuous tension on the strap end, the strap does not loosen during the tightening and closing operation seen in FIGS. 7 and 8. The bottom portion of the strap loop adjacent a heel 174 of the skier's hand, see FIG. 8, is tightened firmly. Thus, the snugged strap loop serves as a bottom platform for the ski pole grip, and supports the skier's hand and arm against downward movement when making a pole plant. There is no need for the bottom portion of the ski handle 102 to have a flared support platform for supporting the skier's hand during a downward pole plant.

Prior ski pole grips having a single point attachment loop for a strap have not been capable of adequately performing the function of a heel platform because of the difficulty of tightening the strap loop sufficiently to firmly engage the gloved hand. Many slide buckles used on a loop strap require two hands to adjust the length of the strap, and therefore cannot be tightened adequately once the skier's hand is inside the looped strap. The quick adjustment and lock feature of the present invention can be performed even by a gloved hand which has reduced capability of making fine adjustments by the fingers and thumb of one hand.

Ski pole grips are known having a two point attachment system in which a strap more snugly extends from the top of the handle. However, such two point attachment system may obstruct the release of the skier's hand from the ski pole during a fall. It is preferred that the skier be able to open his hand during a fall and allow the ski pole grip and shaft to experience free motion without clamping engagement with the skier's hand. Furthermore, it is desirable that the strap loop still maintain some attachment to the ski pole to prevent losing the ski pole during the fall. All of these advantages, without the disadvantages of a two point strap attachment system, are provided by the ski pole grip and strap adjustment system 100.

The ski pole and strap adjustment system 100 is universal in that it can be readily manufactured without requiring separate right and left handles. However, the free end 30 will extend from the same side of the ski pole loop for both the right and left hands. As illustrated by way of example, the free end 30 can be located to the right, and thus would be outward of the skier's wrist for the skier's right hand. The left hand of the skier when inserted in the strap loop would likewise locate the free end 30 to the right and therefore would have a tendency to flop over the left hand to an inward position facing the skier, which may be distracting depending on the length of the free end.

In order to orient the free end 30 better for the left hand, i.e. as a mirror image of the right hand version, the strap system as seen in FIG. 5 can be removed from vertical slot 130 and flipped over by 180° from the orientation seen in FIG. 5. The spreader member 160 is then snapped back over the flipped strap, and inserted back into the vertical slot 130 to be captured by the pin 134. This will create a left-hand orientation for the strap system if desired by the skier. The strap system can be assembled with a common orientation for all ski pole grips and attached straps, and instructions given in a booklet accompanying the ski pole grips so that an end user can customize the strap system for right hand and left hand orientation if desired. Alternatively, the customization can occur at the time of assembly. Furthermore, the strap loop can be readily replaced at any time as for repair.

The ski pole grip and strap adjustment system 100 is also universal in that it can expand the range of hand sizes which are accommodated by the ski grip. In known ski pole grips having a heel platform extending from a bottom of the handle, the bottom platform and top platform formed by a bulbous top should abut the gloved hand if it is to adequately support both the heel portion and top of a gloved hand. A compromise in the length of the handle is necessary to fit most hand sizes. A larger hand size and a smaller hand size are not accommodated well in such a typical prior grip. Because the heel support is provided by the novel strap system described herein, the handle 102 can be of greater extent than a standard ski pole handle. This allows the novel ski pole grip and strap system to accommodate a greater variety of hand sizes, and thus is more universal in that it fits a greater percentage of the population of hand sizes. This is a substantial advantage compared to prior ski grips where the heel platform must be molded as an integral part of the lower part of the handle itself.

Various modifications can be made as desired. For example, the end pull tab 32 could be formed as a U-shaped snap which can be snapped over the adjacent strap after closing the buckle in order to maintain the free end against the strap during use. This would prevent the free end from flailing about and would keep it snugly against the loop strap. Other modifications will be apparent to one of ordinary skill in the art.

What is claimed is:

1. A ski pole grip and strap system, comprising:

an elongated hollow handle having a recess in a lower end for receiving a ski pole shaft, a front gripping surface extending vertically along the handle for receiving fingers of a skier's hand, a top portion of the handle extending above the front gripping surfaces and including a vertical mounting slot extending co-planar with the elongated handle, a wrist strap formed of a web which is wide and includes a first web portion and second web portion seated in the vertical mounting slot and extend outwardly so that the web portions face each other, a spreader member insertable into the vertical mounting slot between the first and second web portions to spread apart the web portions which face each other as the web portions extend outwardly from the vertical slot, and an adjustable buckle for interconnecting the first and second web portions in order to form a loop for a skier's hand, including an adjustment mechanism for sliding movement of the web portions to adjust the loop length.

2. The system of claim 1 wherein the top portion of the handle includes a horizontal bore extending entirely through the handle from side to side and intersecting the vertical slot, and a removable pin mountable in the bore to capture the strap portions when seated in the vertical mounting slot.

3. The system of claim 1 wherein the spreader member has a plate portion and an extending leg portion, the leg portion being insertable into the vertical mounting slot so that the plate portion is located between and separates apart the first strap portion from the second strap portion.

4. The system of claim 3 wherein the plate portion has slanting sides which are of symmetrical shape to spread apart the strap portions even should the leg portion be flipped when being inserted into the vertical mounting slot.

5. The system of claim 1 wherein the spreader member includes a spreader plate having a first set of slanted edges engagable with the first and second web portions to spread apart the web portions and a second set of slanted edges engagable with the first and second web portions to spread apart the web portions, the spreader member being insertable into the vertical mounting slot in a first position so that the first set of slanted edges engages and spreads apart the first and second web portions or being insertable in a second position so that the second set of slanted edges engages and spreads apart the first and second web portions to thereby open the loop for both the first and second positions for the spreader member.

* * * * *